US006727648B2

(12) United States Patent
Kang

(10) Patent No.: US 6,727,648 B2
(45) Date of Patent: Apr. 27, 2004

(54) PLASMA DISPLAY PANEL

(75) Inventor: Seok Dong Kang, Kumi-shi (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/291,605

(22) Filed: Nov. 12, 2002

(65) Prior Publication Data

US 2003/0090205 A1 May 15, 2003

(30) Foreign Application Priority Data

Nov. 13, 2001 (KR) ..... 2001-0070466

(51) Int. Cl.[7] ..... H01J 17/49

(52) U.S. Cl. ..... 313/582; 313/466; 313/473

(58) Field of Search ..... 313/466, 473, 313/582

*Primary Examiner*—Vip Patel
(74) *Attorney, Agent, or Firm*—Fleshner & Kim, LLP

(57) ABSTRACT

There is explained a plasma display panel that is capable of preventing discoloration of a substrate caused by migration of a metal bus electrode or metal paste's running down.

A plasma display panel according to an embodiment of the present invention includes a transparent electrode; a metal bus electrode formed on the transparent electrode; and a black layer formed on a side surface of the transparent electrode and between the metal bus electrode and the transparent electrode.

10 Claims, 3 Drawing Sheets

PLASMA DISPLAY PANEL

BACKGROUND OF THE INVENTION

1. Field of the Invention

This invention relates to a plasma display panel, and more particularly to a plasma display panel that is capable of preventing discoloration of a substrate caused by migration of a metal bus electrode or metal paste's running down.

2. Description of the Related Art

Generally, a plasma display panel (PDP) radiates a fluorescent body by an ultraviolet with a wavelength of 147 nm generated during a discharge of He+Xe or Ne+Xe gas to thereby display a picture including characters and graphics. Such a PDP is easy to be made into a thin-film and large-dimension type. Moreover, the PDP provides a very much improved picture quality owing to a recent technical development. Particularly, a three-electrode, alternating current (AC) surface-discharge type PDP has advantages of a low-voltage driving and a long life in that it can lower a voltage required for a discharge using wall charges accumulated on the surface thereof during the discharge and protect the electrodes from a sputtering caused by the discharge. Further, the PDP has advantages that its fabricating process is simple, it is easier to be made into a large screen and its response speed is fast because it does not have to form an active switching device every cell in the same way as a liquid crystal display panel LCD.

Referring to FIG. 1, a discharge cell of the three-electrode, AC surface-discharge PDP includes a scanning electrode 30Y and a sustaining electrode 30Z formed on an upper substrate 10, and an address electrode 20X formed on a lower substrate 18.

The scanning electrode 30Y and the sustaining electrode 30Z include a transparent electrode 12Y or 12Z, and a metal bus electrode 13Y or 13Z having a smaller line width than the transparent electrode 12Y or 12Z and provided at one edge of the transparent electrode, respectively. The transparent electrodes 12Y and 12Z are formed from indium-tin-oxide ITO on the upper substrate 10. The metal bus electrodes 13Y and 13Z are formed by going through an etching process after depositing chrome Cr/copper Cu/chrome Cr by a deposition method, or by going through a patterning and firing process after printing photosensitive silver Ag paste. On the upper substrate 10 provided with the scanning electrode 30Y and the sustaining electrode 30Z, an upper dielectric layer 14 and a protective film 16 are disposed. Wall charges generated upon plasma discharge are accumulated in the upper dielectric layer 14. The protective film 16 protects the upper dielectric layer 14 from a sputtering generated during the plasma discharge and improves the emission efficiency of secondary electrons. This protective film 16 is usually made from magnesium oxide MgO. The address electrode 20X is formed in a direction crossing the scanning electrode 30Y and the sustaining electrode 30Z. A lower dielectric layer 22 and barrier ribs 24 are formed on the lower substrate 18 provided with the address electrode 20X. A fluorescent material layer 26 is coated on the surfaces of the lower dielectric layer 22 and the barrier ribs 24. The barrier ribs 24 are formed in parallel to the address electrode 20X to divide the discharge cell physically and prevent an ultraviolet ray and a visible light generated by the discharge from being leaked into the adjacent discharge cells. The fluorescent material layer 26 is excited and radiated by an ultraviolet ray generated upon plasma discharge to produce a red, green or blue color visible light ray.

An inactive mixture gas, such as He+Xe or Ne+Xe, for a gas discharge is injected into a discharge space defined between the upper/lower substrate 10 and 18 and the barrier ribs 24.

Such a three-electrode AC surface-discharge PDP drives one frame, which is divided into various sub-fields having a different emission frequency, so as to realize gray levels of a picture. Each sub-field is again divided into a reset interval for uniformly causing a discharge, an address interval for selecting the discharge cell and a sustaining interval for realizing the gray levels depending on the discharge frequency. When it is intended to display a picture of 256 gray levels, a frame interval equal to 1/60 second (i.e. 16.67 msec) in each discharge cell is divided into 8 sub-fields SF1 to SF8 as shown in FIG. 2. Each of the 8 sub-fields SF1 to SF8 is divided into a reset interval, an address interval and a sustaining interval. The reset interval and the address interval of each sub-field are equal every sub-field, whereas the sustaining interval and the discharge frequency are increased at a ratio of $2^n$ (wherein n=0, 1, 2, 3, 4, 5, 6 and 7) at each sub-field. Since the sustaining interval becomes different at each sub-field as mentioned above, the gray levels of a picture can be realized.

By the way, the conventional PDP has a problem of discoloration of the substrate 10 caused by migration of the metal bus electrodes 13 and 13Z or the fact that silver Ag paste runs down the substrate 10 in case that the silver Ag paste is printed to form the metal bus electrodes 13Y and 13Z. The migration means that cation of silver Ag+ is eluted from an anode and moves to a cathode under dissolved oxygen in case of there being a voltage difference between two adjacent electrodes, which are the cathode and anode respectively. Sometimes, the cation of silver eluted discolors the surface of the substrate 10 in such migration process. The most significant cause of such substrate discoloration lies in an upper plate structure of the PDP. That will be described in detail in conjunction with FIG. 2 and 3.

Referring to FIG. 2, metal bus electrodes 13Y and 13Z formed in a conventional PDP has their outer edge go in more by a certain length 5 toward the center of a cell than the outer edge of transparent electrodes 12Y and 12Z located at the outer area of the cell. And the inner edge of the conventional metal bus electrodes 13Y and 13Z goes in more by a certain length t0 toward the outer of a cell than the inner edge of transparent electrodes 12Y and 12Z. There is a black layer 28 with conductivity formed between the metal bus electrodes 13Y and 13Z and the transparent electrodes 12Y and 12Z. The black layer 28 is formed by oxidizing metal or printing and patterning paste where metal powder and black pigment are mixed together. The black layer 28 act to prevent a contrast deterioration of a display screen caused by external light being reflected from the metal bus electrode 13Y and 13Z by absorbing the external light.

According to a structure of the metal bus electrodes 13Y and 13Z as in FIG. 2, the silver Ag paste is likely to run down to the transparent electrodes 12Y and 12Z or the substrates 10 so as to cause the substrate 10 to be discolored when the silver Ag paste is printed to form the metal bus electrodes 13Y and 13Z. This is because the outer edges of the metal bus electrodes 13Y and 13Z are close to the transparent electrodes 12Y and 12Z or the substrate 10. Further, anion of the metal bus electrodes 13Y and 13Z is likely eluted to discolor the substrate 10 by such a structure.

There is a PDP where an oxidized film is formed on the substrate 10 as in FIG. 3 as another scheme for reducing the problem of the substrate discoloration.

Referring to FIG. 3, another conventional PDP includes an oxidized film 30 formed of silicon oxide SiO between transparent electrodes 12Y and 12Z and a substrate 10. In this PDP too, metal bus electrodes 13Y and 13Z has their outer edge go in more by a certain length δ toward the center of a cell than the outer edge of transparent electrodes 12Y and 12Z located at the outer area of the cell. And the inner edge of the metal bus electrodes 13Y and 13Z goes in more by a certain length to toward the outer of a cell than the inner edge of transparent electrodes 12Y and 12Z. There is a black layer 28 with conductivity formed between the metal bus electrodes 13Y and 13Z and the transparent electrodes 12Y and 12Z. The oxidized film 30 is formed between the metal bus electrodes 13Y and 13Z and the substrate 10 so as to shut off for silver paste or silver ion eluted from the metal bus electrodes 13 and 13*z* not to move toward the substrate 10.

However, in case that the oxidized film is formed on the PDP as in FIG. 3, because it has lower transparency than glass, the aperture ratio and brightness of the PDP is deteriorated and equipment and a process for depositing the oxidized film should be additionally required.

Moreover, the PDP as in FIG. 2 or 3 has the metal bus electrode 13Y and 13Z formed a little to the inner side of a discharge cell, so that there is a problem of the aperture ratio being that much smaller.

SUMMARY OF THE INVENTION

Accordingly, it is an object of the present invention to provide a plasma display panel that is capable of preventing discoloration of a substrate caused by migration of a metal bus electrode or metal paste's running down.

In order to achieve these and other objects of the invention, a plasma display panel according to an aspect of the present invention includes a transparent electrode; a metal bus electrode formed on the transparent electrode; and a black layer formed on a side surface of the transparent electrode and between the metal bus electrode and the transparent electrode.

Herein, an area of the black layer is 1.5 times as big as an area of the metal bus electrode.

The metal bus electrode includes silver Ag.

The black layer is formed on an outer upper surface of the transparent electrode located an outer side of a discharge cell.

Herein, an outer edge of the metal bus electrode is aligned to an outer edge of the transparent electrode located at an outer side of a discharge cell.

A plasma display panel having an upper substrate and a lower substrate sealed a discharge gas injected into a discharge space of the inside thereof according to another aspect of the present invention includes a transparent electrode formed on the upper substrate; a metal bus electrode aligned to one side edge of the transparent electrode; and a black layer formed between the transparent electrode and the metal bus electrode and on a side surface of the metal bus electrode.

Herein, an area of the black layer is 1.5 times as big as an area of the metal bus electrode.

The metal bus electrode includes silver Ag.

The black layer is formed on an outer upper surface of the transparent electrode located an outer side of a discharge cell.

Herein, an outer edge of the metal bus electrode is aligned to an outer edge of the transparent electrode located at an outer side of a discharge cell.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Figure 4:
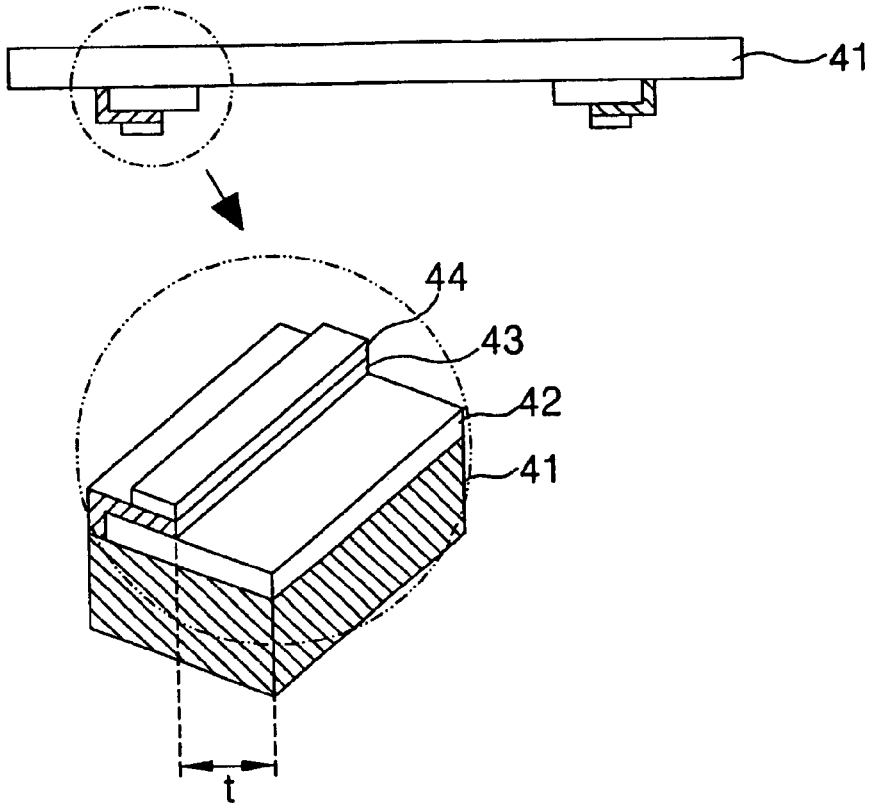
FIG. 4 is a diagram representing part of an upper plate of a PDP according to an embodiment of the present invention.
Figure 5:
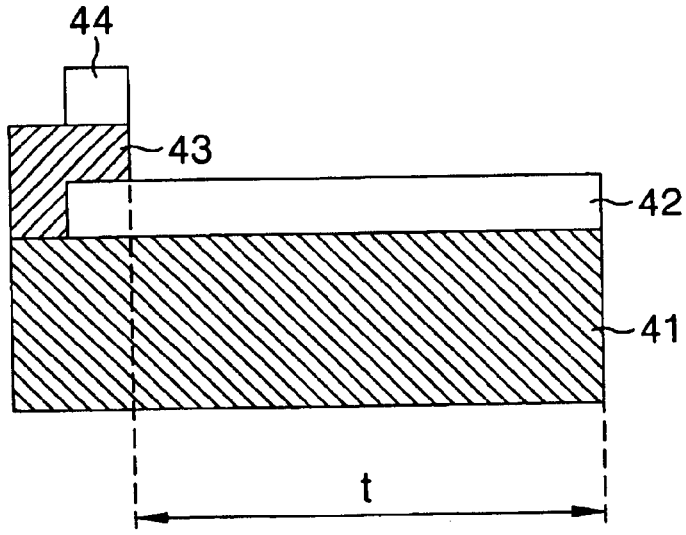
FIG. 5 illustrates a sectional view of a transparent electrode, a black layer and a metal bus electrode shown in FIG. 4.

Referring to FIGS. 4 and 5, a PDP according to an embodiment of the present invention includes a transparent electrode 42 formed on an upper substrate 41, a black layer 43 covering the outside edge and part of an upper surface of the transparent electrode 42, and a metal bus electrode formed on top of the transparent electrode 42 with the black layer 43 therebetween.

The upper substrate 41 is made from materials, such as transparent glass, plastic and ceramics etc. A scanning electrode and a sustaining electrode are composed of the transparent electrode 42, the metal bus electrode and the black layer 43 as deposited in FIG. 4.

The black layer 43 covers the outer upper surface of the transparent electrode 42, is bent at the outer edge of the transparent electrode 42 to cover the outer side of the transparent electrode 42. The black layer 43 is formed by oxidizing metal or printing and patterning pasted where metal powder and black pigment are mixed together. The black layer 43 absorbs an external light incident to the metal bus electrode 44 or an external light reflected from the metal bus electrode 44 to increase contrast, and in case that silver paste runs down in a printing process of the metal bus electrode 44, the distance between the metal bus electrode 44 and the upper substrate 41 is made to be extended as compared with prior art, thereby preventing a discoloration of the upper substrate,41 caused by electrode material. Further, the black layer 43 has the distance between the metal bus electrode 44 and the upper substrate 41 extended to shut off a migration due to an ion elution of the electrode material, thereby preventing the discoloration of the upper substrate 41.

The area of the black layer 43 is 1.5 times as big as the area of the metal bus electrode 44. The end of the outer edge of the black layer 43 is in contact with the upper substrate 41.

The black layer 43 should not overlap with a black layer of an adjacent discharge cell and be located between the metal bus electrode 44 and the upper substrate 41 for the metal bus electrode 44 not to make direct contact to the upper substrate 41 when changing the structure of the transparent electrode 42 or the metal bus electrode 44.

Figure 2:
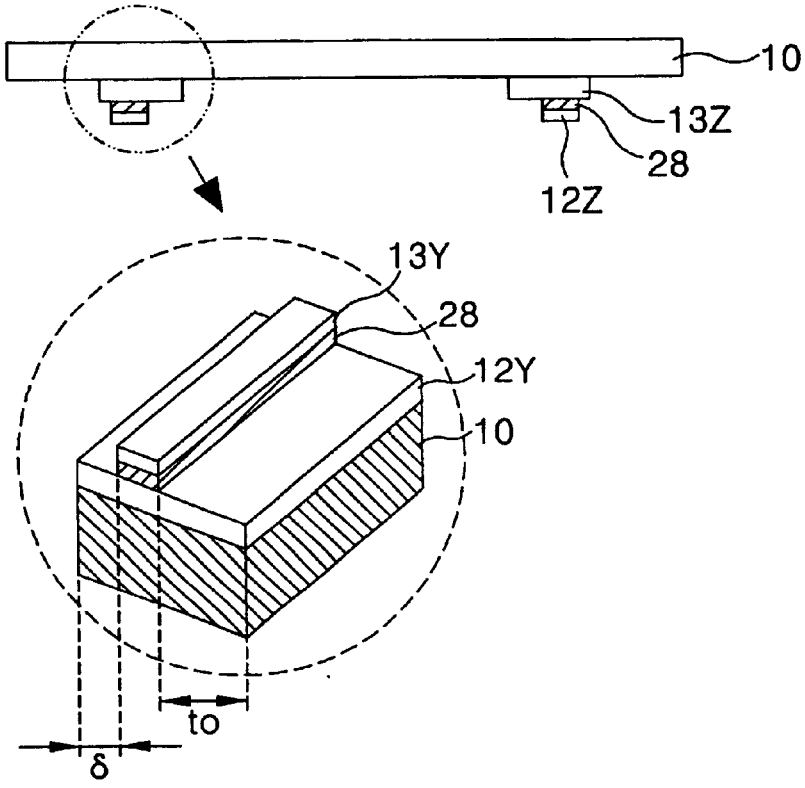
FIG. 2 RELATED ART
FIG. 2 illustrates in detail part of an upper plate of the PDP including a metal bus electrode shown in FIG. 1.
Figure 3:
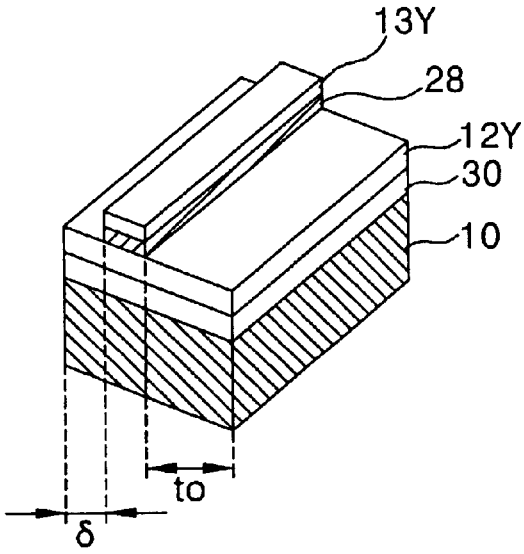
FIG. 3 RELATED ART
FIG. 3 is a sectional perspective view representing part of an upper plate of another conventional PDP where an oxidized film is formed.

The outer edge of metal bus electrode 44 and the outer edge of the transparent electrode 42 are almost the same in their location or are located on the same vertical line. And, the metal bus electrode 44 is formed a little to the outer side of a cell the inner edge of which is separated with a distance of t from the inner edge of the transparent electrode 42. As can be seen in FIG. 2 and 4, the distance between the inner edge of the metal bus electrode 44 and the inner edge of the transparent electrode 42 is extended from a conventional t0 to t. t is greater than t0. Accordingly, the metal bus electrode 44 has its width set narrow and is positioned a little to the outer side of the discharge cell so as to increase an aperture ratio and brightness of each discharge cell as much.

Figure 1:
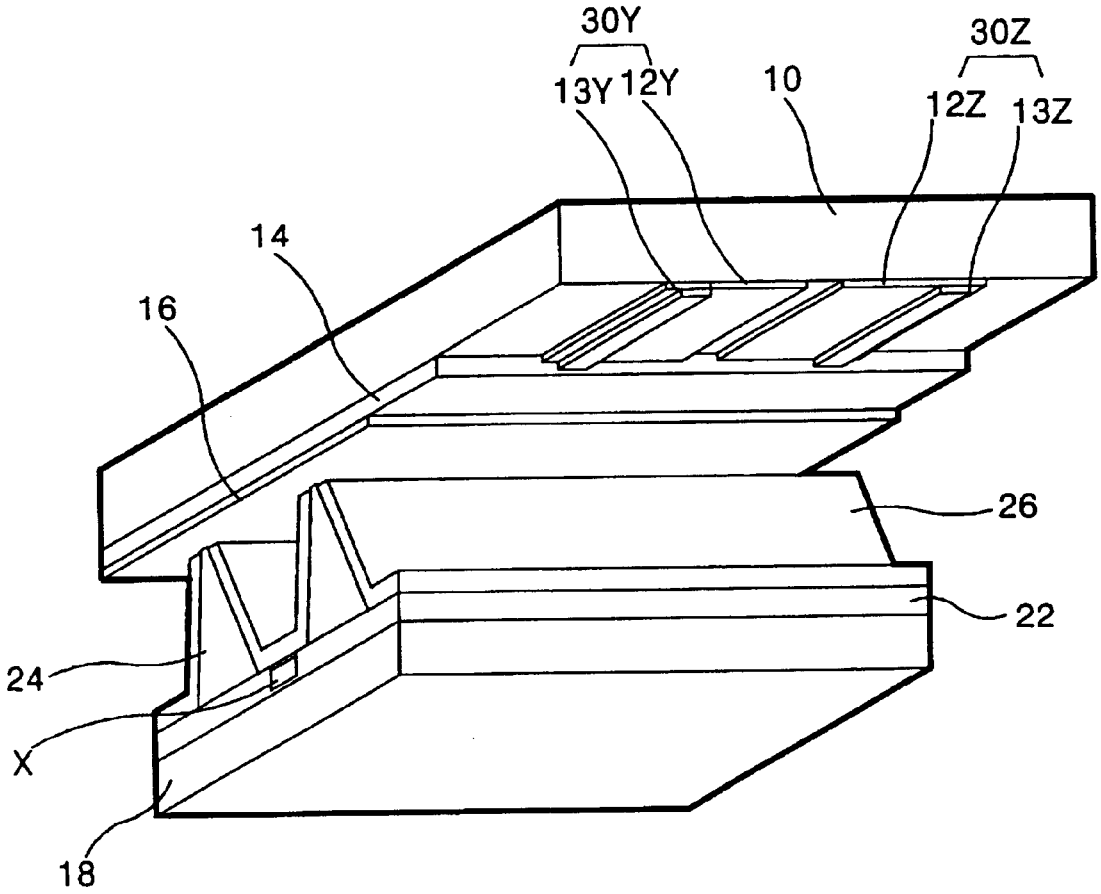
FIG. 1 RELATED ART
FIG. 1 is a perspective view representing a discharge cell structure of a conventional three-electrodes AC surface discharge type PDP.

On an upper plate of the PDP is also formed a dielectric layer (not shown) deposited on the upper substrate land a protective film (not shown) to cover the transparent electrode 42, the black layer 43 and the metal bus electrode 44. The upper plate of the PDP with such a structure is jointed to a lower plate shown in FIG. 1 and they were sealed. There is inactive mixture gas such as He+Xe, Ne+Xe or He+Ne+Xe etc injected into a discharge space between the upper plate and the lower plate.

As described above, the PDP according to the present invention includes the black layer covering the outer side and the part of the outer upper surface of the transparent electrode and has the metal bus electrode formed on the upper surface of the black layer. Accordingly, the PDP according to the present invention shuts off the running down or the migration of the metal paste that forms the metal bus electrode to prevent the discoloration of the substrate due to the migration of the metal bus electrode or the running down of the metal paste. Further, the PDP according to the present invention has the metal bus electrode aligned to the outer edge of the transparent electrode and positioned a little to the outer side of the discharge cell so that the space use rate of the transparent electrode increases and the aperture and brightness of each discharge cell increases. Moreover, the PDP according to the present invention shuts off the running down or the migration to form a transparent electrode with various structures without any concern about the substrate discoloration.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A plasma display panel, comprising:

a transparent electrode;

a metal bus electrode formed on the transparent electrode; and a black layer formed on a side surface of the transparent electrode and between the metal bus electrode and the transparent electrode.

2. The plasma display panel according to claim 1, wherein an area of the black layer is 1.5 times as big as an area of the metal bus electrode.

3. The plasma display panel according to claim 1, wherein the metal bus electrode includes silver Ag.

4. The plasma display panel according to claim 1, wherein the black layer is formed on an outer upper surface of the transparent electrode located an outer side of a discharge cell.

5. The plasma display panel according to claim 1, wherein an outer edge of the metal bus electrode is aligned to an outer edge of the transparent electrode located at an outer side of a discharge cell.

6. A plasma display panel having an upper substrate and a lower substrate sealed a discharge gas injected into a discharge space of the inside thereof, comprising:

a transparent electrode formed on the upper substrate;

a metal bus electrode aligned to one side edge of the transparent electrode; and a black layer formed between the transparent electrode and the metal bus electrode and on a side surface of the metal bus electrode.

7. The plasma display panel according to claim 6, wherein an area of the black layer is 1.5 times as big as an area of the metal bus electrode.

8. The plasma display panel according to claim 6, wherein the metal bus electrode includes silver Ag.

9. The plasma display panel according to claim 6, wherein the black layer is formed on an outer upper surface of the transparent electrode located an outer side of a discharge cell.

10. The plasma display panel according to claim 6, wherein an outer edge of the metal bus electrode is aligned to an outer edge of the transparent electrode located at an outer side of a discharge cell.

* * * * *